US009325117B1

(12) United States Patent
Wu

(10) Patent No.: US 9,325,117 B1
(45) Date of Patent: Apr. 26, 2016

(54) PIN STRUCTURE OF MODULAR JACK

(71) Applicant: HSING CHAU INDUSTRIAL CO., LTD., Taipei (TW)

(72) Inventor: Kei-Wei Wu, Taipei (TW)

(73) Assignee: HSING CHAU INDUSTRIAL CO., LTD. (TW)

( * ) Notice: Subject to any disclaimer, the term of this patent is extended or adjusted under 35 U.S.C. 154(b) by 51 days.

(21) Appl. No.: 14/527,799

(22) Filed: Oct. 30, 2014

(51) Int. Cl.
*H01R 13/10* (2006.01)
*H01R 33/00* (2006.01)
*H01R 13/6461* (2011.01)

(52) U.S. Cl.
CPC ..... *H01R 13/6461* (2013.01)

(58) Field of Classification Search
CPC ..... H01R 13/6461
USPC ..... 439/682, 676, 404, 405, 941
See application file for complete search history.

(56) References Cited

U.S. PATENT DOCUMENTS 5,295,869 A * 3/1994 Siemon ..... G02B 6/3897 361/301.1

* cited by examiner

*Primary Examiner* — Javaid Nasri
(74) *Attorney, Agent, or Firm* — Schmeiser, Olsen & Watts, LLP

(57) ABSTRACT

A pin structure of a modular jack has eight resilient pins. The two intermediate resilient pins have two electrically conducting segments vertically spaced apart and are each wide and have two electrically contacting segments transversely spaced apart and are each slender, whereas the other resilient pins are transversely and consecutively spaced apart and disposed on two sides of the two intermediate resilient pins and are each slender. The electrically fixing ends of the first, third, fifth, seventh resilient pins lie in a first straight line. The electrically fixing ends of the second, fourth, sixth, eighth resilient pins lie in a second straight line. The first and second straight lines are spaced apart and lie on the same plane. The resilient pins have V-shaped electrically contacting portions lying in a third straight line. Hence, the pin structure of a modular jack reduces crosstalk and loss and thereby meets strict standards.

5 Claims, 18 Drawing Sheets

A-A

B-B

PIN STRUCTURE OF MODULAR JACK

FIELD OF TECHNOLOGY

The present invention relates to pin structures of a modular jacks, and more particularly, to a pin structure of a modular jack so as to reduce crosstalk and loss in order to meet strict standards.

BACKGROUND

Over the past few years, advances in network transmission have facilitated an explosive increase in data transmission rate. And in data transmission nowadays, it is advantageous to transmit signals over a pair of conductors, which is recognized as "differential pair", rather than over a single conductor. The way it works is having signals transmitted on each conductor with equal magnitudes but opposite phases. Data transmission using differential pair technique is acknowledged as balanced transmission. Comparing to single-ended transmission, differential signals are generally more immune to the effects of external electrical noises. And usually, the two conductors of a differential pair for network transmission are twisted in a precisely managed ratio. The well-controlled twists increase the noise immunity and reduce the bit error rate (BER) of data transmission.

Considering the ascendency of differential copper cabling in the market today, the standards have been continuously focusing on keeping the same user-friendly RJ-45 connector interface allowing for backward compatibility. The RJ-45 connector was originally adopted as a standard specified interface of network connectors back in 1991 when the data transmission speed was set to 10 Mbs/sec with operating frequency up to 16 MHz only, which was referred to as Category 3.

Now, the most up-to-date Augmented Category 6 standards (e.g. TIA-568-C.2 & ISO-11801 ed.2) compliance with IEEE 802.3an 10GBASE-T protocol is set to use RJ-45 connector remains. However, the transmission speed is specified 1,000 times higher (10 Gbs/sec) with operating frequency up to 500 MHz. Using RJ-45 connectors at high frequencies leads to extreme challenges due to the crosstalks and losses come along with the fixed RJ-45 geometry.

When it comes to qualification of transmission capability of a RJ-45 modular jack or patch panel connecting hardware (hereinafter referred to as "jack"), there are two types of measurements need to be taken into consideration. They are transmission (crosstalk) and reflection (loss). Among the transmission requirements specified by standard, near end crosstalk (NEXT), far end crosstalk (FEXT), and insertion loss (IL) are the key parameters which have to be satisfied while return loss (RL) is the parameter determined with a reflection measurement.

Energy from one signal conductor may be partially introduced to couple into adjacent signal conductor by the electric field generated between two signal conductors and the magnetic field generated owing to the variation of electric field simultaneously. This capacitive and inductive coupling represents the phenomenon of crosstalk. Crosstalks are the unwanted signals electromagnetically coupled from another conductor unintentionally. Therefore, those distortional signals usually affect the signals that are supposed to run through the disturbed differential signal path.

Crosstalk comes from the legacy of RJ-45 modular plug (hereinafter referred to as "plug"), which has a significant amount of crosstalk coupling (NEXT and FEXT) when being mated with a jack. The standard RJ-45 jack housing utilizes a straightforward design with a spaced interval 1.016 mm of resilient pins from 1 to 8 in a relative uniform and parallel alignment (FIG. 1).

Among the wire pairs that are crimped with contact blades proximally inside the plug, capacitive and inductive couplings are parasitized therein. The contact blades have a large area to react themselves as a transmitting and receiving antenna. And the split of wire pair positioned in contact 3 and contact 6 worsens all the pair combinations by coupling adjacent three other pairs. Among all the signal interference, the near end coupling between Pair 1 and Pair 3 is the most severe one due to the Pair 3 is diverged and physically enfold the Pair 1 (FIG. 2). Therefore, when a RJ-45 jack is connected to a RJ-45 plug to transmit high-frequency data signals, crosstalks generated and reflected losses caused by impedance mismatches right at the mating area increase dramatically. Especially high NEXT and FEXT are produced for certain adjacent wire pairs therein. It all makes sense because the mated resilient pin 3 (tip) is closer to the mated resilient pin 4 (ring) than is to the mated resilient pin 5 (tip). Likewise, the mated resilient pin 6 (ring) is closer to the mated resilient pin 5 (tip) than is to the mated resilient pin 4 (ring)(FIG. 3). Consequently differential capacitive and inductive couplings occurs between the mated Pair 1 and Pair 3 that generate hugely both NEXT and FEXT.

A RJ-45 jack that is configured to suppress or to compensate for crosstalk introduced by a mating RJ-45 plug, is generally known. The way to relieve crosstalk problem is conceptually performed by employing capacitive and inductive couplings equal to and opposite to the noise signals such that the induced noise signals are effectively cancelled by the induced correction signals. This implementation is referred to as "compensation". In other words, if electromagnetic compensation inside a modular jack is in opposite polarity and substantially equal in magnitude to a modular plug, a balanced differential signal transmission can be achieved.

Referring to FIG. 4, the NEXT vector of a RJ-45 standard specified plug derived from standard specified method is demonstrated. Obviously, Pair 1 and Pair 3 have to be capacitively and inductively compensated the most so as to enable desirable balanced transmission.

Accordingly, it is imperative to provide a pin structure of a modular jack to reduce crosstalk and loss and thereby meet strict standards.

SUMMARY

In view of the drawbacks of the conventional, the inventor of the present invention conducted extensive researches and experiments according to the inventor's years of experience in the related industry, and finally developed a pin structure of a modular jack as disclosed in the present invention to reduce crosstalk and loss and thereby meet strict standards.

In order to achieve the above and other objectives, the present invention provides a pin structure of a modular jack, comprising a first resilient pin, a second resilient pin, a third resilient pin, a fourth resilient pin, a fifth resilient pin, a sixth resilient pin, a seventh resilient pin, and an eighth resilient pin.

The first resilient pin has a first electrically conducting segment and a first electrically contacting segment connected to the first electrically conducting segment. The first electrically conducting segment has a first electrically fixing end. The first electrically contacting segment has a first V-shaped electrically contacting portion.

The second resilient pin has a second electrically conducting segment and a second electrically contacting segment connected to the second electrically conducting segment. The second electrically conducting segment has a second electrically fixing end. The second electrically contacting segment has a second V-shaped electrically contacting portion.

The third resilient pin has a third electrically conducting segment and a third electrically contacting segment connected to the third electrically conducting segment. The third electrically conducting segment has a third electrically fixing end. The third electrically contacting segment has a third V-shaped electrically contacting portion.

The fourth resilient pin has a fourth electrically conducting segment and a fourth electrically contacting segment connected to the fourth electrically conducting segment. The fourth electrically conducting segment has a fourth electrically fixing end. The fourth electrically contacting segment has a fourth V-shaped electrically contacting portion.

The fifth resilient pin has a fifth electrically conducting segment and a fifth electrically contacting segment connected to the fifth electrically conducting segment. The fifth electrically conducting segment has a fifth electrically fixing end. The fifth electrically contacting segment has a fifth V-shaped electrically contacting portion.

The sixth resilient pin has a sixth electrically conducting segment and a sixth electrically contacting segment connected to the sixth electrically conducting segment. The sixth electrically conducting segment has a sixth electrically fixing end. The sixth electrically contacting segment has a sixth V-shaped electrically contacting portion.

The seventh resilient pin has a seventh electrically conducting segment and a seventh electrically contacting segment connected to the seventh electrically conducting segment. The seventh electrically conducting segment has a seventh electrically fixing end. The seventh electrically contacting segment has a seventh V-shaped electrically contacting portion.

The eighth resilient pin has an eighth electrically conducting segment and an eighth electrically contacting segment connected to the eighth electrically conducting segment. The eighth electrically conducting segment has an eighth electrically fixing end. The eighth electrically contacting segment has an eighth V-shaped electrically contacting portion.

The fourth electrically conducting segment and the fifth electrically conducting segment are vertically spaced apart and are each wide. The fourth electrically contacting segment and the fifth electrically contacting segment are disposed on different sides of the fourth electrically conducting segment and the fifth electrically conducting segment, respectively, and transversely spaced apart, and are each slender. The other resilient pins are spaced transversely and consecutively apart and disposed on two sides of the fourth resilient pin and the fifth resilient pin, respectively and are each slender. The first electrically fixing end, the third electrically fixing end, the fifth electrically fixing end and the seventh electrically fixing end lie in a first straight line. The second electrically fixing end, the fourth electrically fixing end, the sixth electrically fixing end and the eighth electrically fixing end lie in a second straight line. The first straight line and the second straight line are spaced apart and lie on a same plane. The V-shaped electrically contacting portions lie in a third straight line.

The fourth electrically conducting segment and the fifth electrically conducting segment are of a coupling length of 7 cm and a coupling width of 1.5 cm. The distance from a fourth junction of the fourth electrically contacting segment and the fourth electrically conducting segment to the fourth V-shaped electrically contacting portion equals 2 cm. The distance from a fifth junction of the fifth electrically contacting segment and the fifth electrically conducting segment to the fifth V-shaped electrically contacting portion equals 4 cm.

The first electrically contacting segment has a first inner segment and a first outer segment which are connected to two ends of the first V-shaped electrically contacting portion, respectively, and the first inner segment is connected to the first electrically conducting segment.

The second electrically contacting segment has a second inner segment and a second outer segment which are connected to two ends of the second V-shaped electrically contacting portion, respectively, and the second inner segment is connected to the second electrically conducting segment.

The third electrically contacting segment has a third inner segment and a third outer segment which are connected to two ends of the third V-shaped electrically contacting portion, respectively, and the third inner segment is connected to the third electrically conducting segment.

The fourth electrically contacting segment has a fourth inner segment and a fourth outer segment which are connected to two ends of the fourth V-shaped electrically contacting portion, respectively, and the fourth inner segment is connected to the fourth electrically conducting segment.

The fifth electrically contacting segment has a fifth inner segment and a fifth outer segment which are connected to two ends of the fifth V-shaped electrically contacting portion, respectively, and the fifth inner segment is connected to the fifth electrically conducting segment.

The sixth electrically contacting segment has a sixth inner segment and a sixth outer segment which are connected to two ends of the sixth V-shaped electrically contacting portion, respectively, and the sixth inner segment is connected to the sixth electrically conducting segment.

The seventh electrically contacting segment has a seventh inner segment and a seventh outer segment which are connected to two ends of the seventh V-shaped electrically contacting portion, respectively, and the seventh inner segment is connected to the seventh electrically conducting segment.

The eighth electrically contacting segment has an eighth inner segment and an eighth outer segment which are connected to two ends of the eighth V-shaped electrically contacting portion, respectively, and the eighth inner segment is connected to the eighth electrically conducting segment.

The inner segments lie on the same plane. The included angle of the third inner segment and the third outer segment, the included angle of the fifth inner segment and the fifth outer segment, and the included angle of the seventh inner segment and the seventh outer segment equal 50 degrees. The included angle of the first inner segment and the first outer segment, the included angle of the second inner segment and the second outer segment, the included angle of the fourth inner segment and the fourth outer segment, the included angle of the sixth inner segment and the sixth outer segment, and the included angle of the eighth inner segment and the eighth outer segment equal 80 degrees.

As regards the pin structure of a modular jack, the second resilient pin is disposed at a first U-shaped notch between the first resilient pin and the third resilient pin.

As regards the pin structure of a modular jack, the seventh resilient pin is disposed at a second U-shaped notch between the sixth resilient pin and the eighth resilient pin.

Accordingly, the pin structure of the modular jack of the present invention reduces crosstalk and loss and thereby meets strict standards.

BRIEF DESCRIPTION

Objectives, features, and advantages of the present invention are hereunder illustrated with specific embodiments in conjunction with the accompanying drawings, in which.

DETAILED DESCRIPTION

Figure 1:
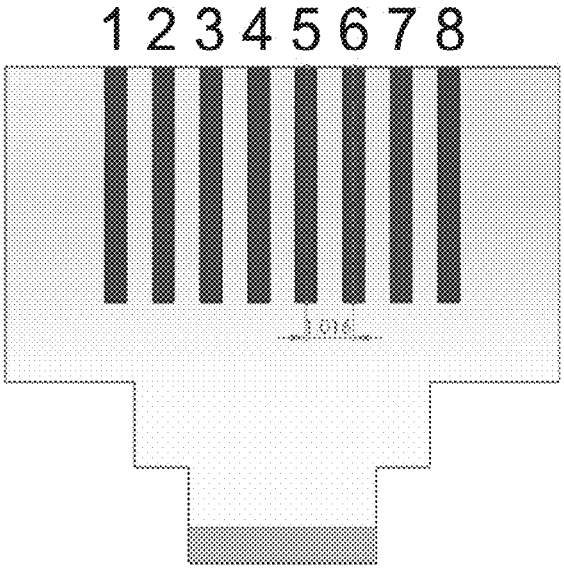
FIG. 1 (BACKGROUND ART)
FIG. 1 (BACKGROUND ART) is a schematic view of a typical standard RJ-45 modular jack.
Figure 2:
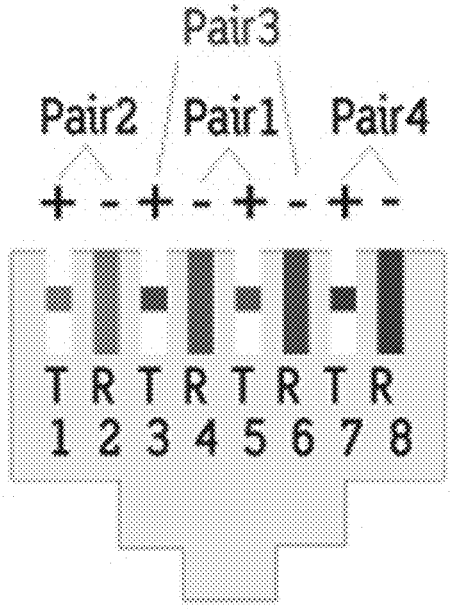
FIG. 2 (BACKGROUND ART)
FIG. 2 (BACKGROUND ART) is a schematic view of a typical standard RJ-45 modular plug.
Figure 3:
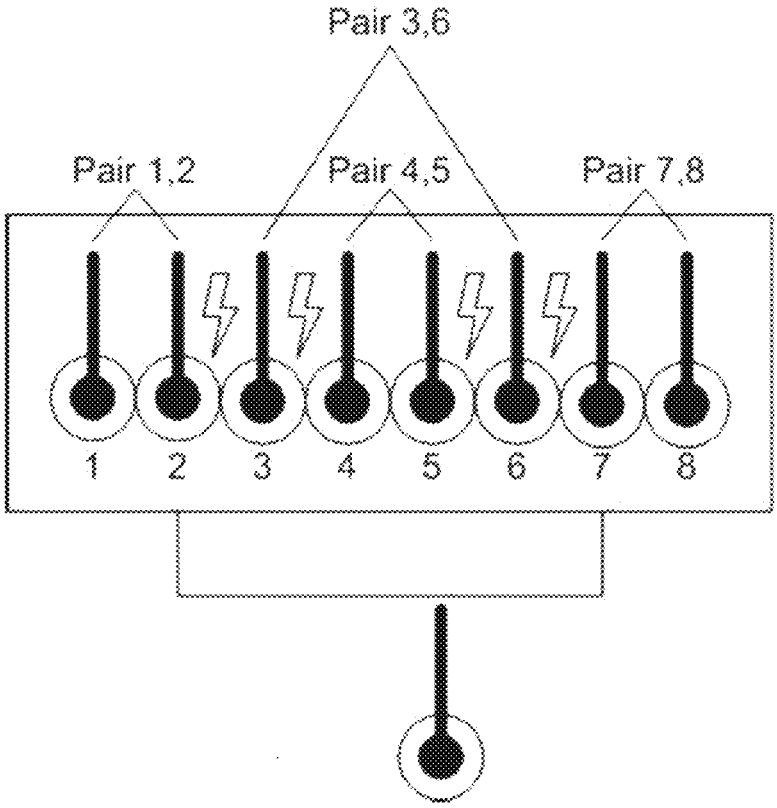
FIG. 3 (BACKGROUND ART)
FIG. 3 (BACKGROUND ART) is a schematic view of crosstalk which occurs to the typical standard RJ-45 modular plug.
Figure 4:
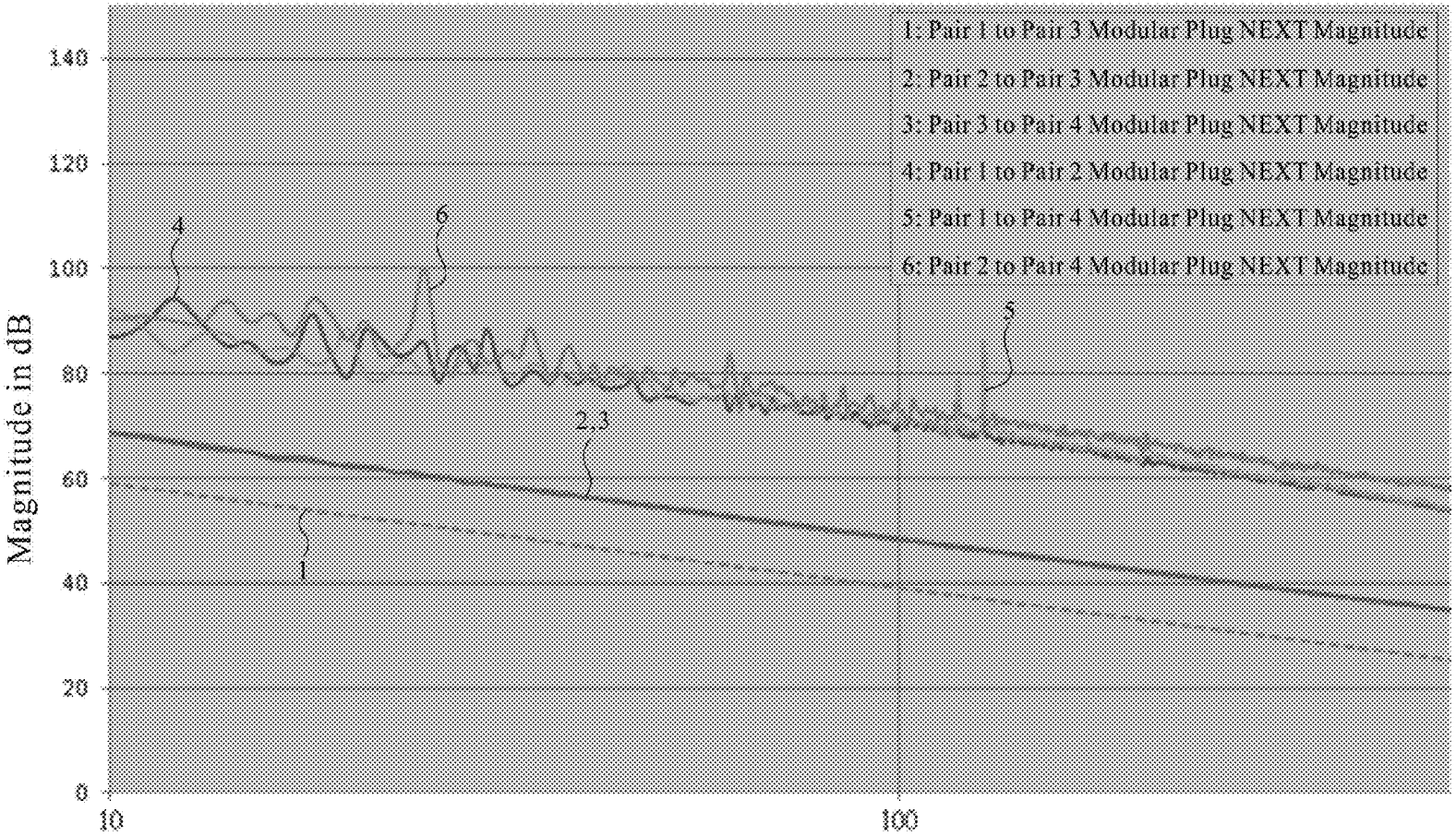
FIG. 4 (BACKGROUND ART)
FIG. 4 (BACKGROUND ART) is a graph of typical standard specified NEXT magnitude of differential pairs of the qualified RJ-45 modular plug against frequency.

Referring to FIG. 5 through FIG. 12, the present invention provides a pin structure 1 of a modular jack. The pin structure 1 of the modular jack comprises a first resilient pin 11, a second resilient pin 12, a third resilient pin 13, a fourth resilient pin 14, a fifth resilient pin 15, a sixth resilient pin 16, a seventh resilient pin 17, and an eighth resilient pin 18. The reference numerals of the resilient pins 11, 12, 13, 14, 15, 16, 17, 18 are the reference numerals of the resilient pins of a RJ-45 modular jack 3 and match the reference numerals of conductive blades of the RJ-45 modular plug 4, respectively, such that, upon completion of the insertion of the modular plug 4 into the modular jack 3, the resilient pins 11, 12, 13, 14, 15, 16, 17, 18 of the modular jack 3 get electrically connected to the conductive blades of the modular plug 4, respectively, in accordance with their reference numerals, to therefore allow the fourth resilient pin 14 and the fifth resilient pin 15 to form a first differential pair, allow the first resilient pin 11 and the second resilient pin 12 to form a second differential pair, allow the third resilient pin 13 and the sixth resilient pin 16 to form a third differential pair, and allow the seventh resilient pin 17 and the eighth resilient pin 18 to form a fourth differential pair. The first resilient pin 11 has a first electrically conducting segment 111 and a first electrically contacting segment 112 which connects to the first electrically conducting segment 111 and meets the first electrically conducting segment 111 at a first junction 114. The first electrically conducting segment 111 has a first electrically fixing end 1111. The first electrically contacting segment 112 has a first V-shaped electrically contacting portion 1121.

The second resilient pin 12 has a second electrically conducting segment 121 and a second electrically contacting segment 122 which connects to the second electrically conducting segment 121 and meets the second electrically conducting segment 121 at a second junction 124. The second electrically conducting segment 121 has a second electrically fixing end 1211. The second electrically contacting segment 122 has a second V-shaped electrically contacting portion 1221.

The third resilient pin 13 has a third electrically conducting segment 131 and a third electrically contacting segment 132 which connects to the third electrically conducting segment 131 and meets the third electrically conducting segment 131 at a third junction 134. The third electrically conducting segment 131 has a third electrically fixing end 1311. The third electrically contacting segment 132 has a third V-shaped electrically contacting portion 1321.

The fourth resilient pin 14 has a fourth electrically conducting segment 141 and a fourth electrically contacting segment 142 which connects to the fourth electrically conducting segment 141 and meets the fourth electrically conducting segment 141 at a fourth junction 144. The fourth electrically conducting segment 141 has a fourth electrically fixing end 1411. The fourth electrically contacting segment 142 has a fourth V-shaped electrically contacting portion 1421.

The fifth resilient pin 15 has a fifth electrically conducting segment 151 and a fifth electrically contacting segment 152 which connects to the fifth electrically conducting segment 151 and meets the fifth electrically conducting segment 151 at a fifth junction 154. The fifth electrically conducting segment 151 has a fifth electrically fixing end 1511. The fifth electrically contacting segment 152 has a fifth V-shaped electrically contacting portion 1521.

The sixth resilient pin 16 has a sixth electrically conducting segment 161 and a sixth electrically contacting segment 162 which connects to the sixth electrically conducting segment 161 and meets the sixth electrically conducting segment 161 at a sixth junction 164. The sixth electrically conducting segment 161 has a sixth electrically fixing end 1611. The sixth electrically contacting segment 162 has a sixth V-shaped electrically contacting portion 1621.

The seventh resilient pin 17 has a seventh electrically conducting segment 171 and a seventh electrically contacting segment 172 which connects to the seventh electrically conducting segment 171 and meets the seventh electrically conducting segment 171 at a seventh junction 174. The seventh electrically conducting segment 171 has a seventh electrically fixing end 1711. The seventh electrically contacting segment 172 has a seventh V-shaped electrically contacting portion 1721.

The eighth resilient pin 18 has an eighth electrically conducting segment 181 and an eighth electrically contacting segment 182 which connects to the eighth electrically conducting segment 181 and meets the eighth electrically conducting segment 181 at an eighth junction 184. The eighth electrically conducting segment 181 has an eighth electrically fixing end 1811. The eighth electrically contacting segment 182 has an eighth V-shaped electrically contacting portion 1821.

The electrically contacting segments 112, 122, 132, 142, 152, 162, 172, 182 are resiliently and electrically connected to the conductive blades of the modular plug 4 through the V-shaped electrically contacting portions 1121, 1221, 1321, 1421, 1521, 1621, 1721, 1821, respectively. The electrically fixing ends 1111, 1211, 1311, 1411, 1511, 1611, 1711, 1811 are fixed to eight fixing holes of a printed circuit board 2 and electrically connected to insulation displacement contacts (IDC), respectively. The fourth electrically conducting segment 141 and the fifth electrically conducting segment 151 are spaced apart vertically and are each wide transversely. The fourth electrically contacting segment 142 is connected to one side of the end of the fourth electrically conducting segment 141. The fifth electrically contacting segment 152 is connected to the other side of the end of the fifth electrically conducting segment 151. The fourth electrically contacting segment 142 and the fifth electrically contacting segment 152 are disposed on different sides of the fourth electrically conducting segment 141 and the fifth electrically conducting segment 151 and spaced apart transversely, and are each slender. The resilient pins 11, 12, 13, 16, 17, 18 are spaced apart transversely and in sequence and disposed on two sides of the fourth resilient pin 14 and the fifth resilient pin 15, and are each slender. Hence, the fourth electrically conducting segment 141 and the fifth electrically conducting segment 151 are of the same width and are wider than the electrically conducting segments 111, 121, 131, 161, 171, 181. The first electrically fixing end 1111, the third electrically fixing end 1311, the fifth electrically fixing end 1511, and the seventh electrically fixing end 1711 lie in a first straight line 91. The second electrically fixing end 1211, the fourth electrically fixing end 1411, the sixth electrically fixing end 1611, and the eighth electrically fixing end 1811 lie in a second straight line 92. The first straight line 91 and the second straight line 92 are parallel, are spaced apart, and lie on the same plane. The V-shaped electrically contacting portions 1121, 1221, 1321, 1421, 1521, 1621, 1721, 1821 lie in a third straight line 93 and open in the same direction. The third straight line 93, the first straight line 91, and the second straight line 92 are parallel.

Figure 13:
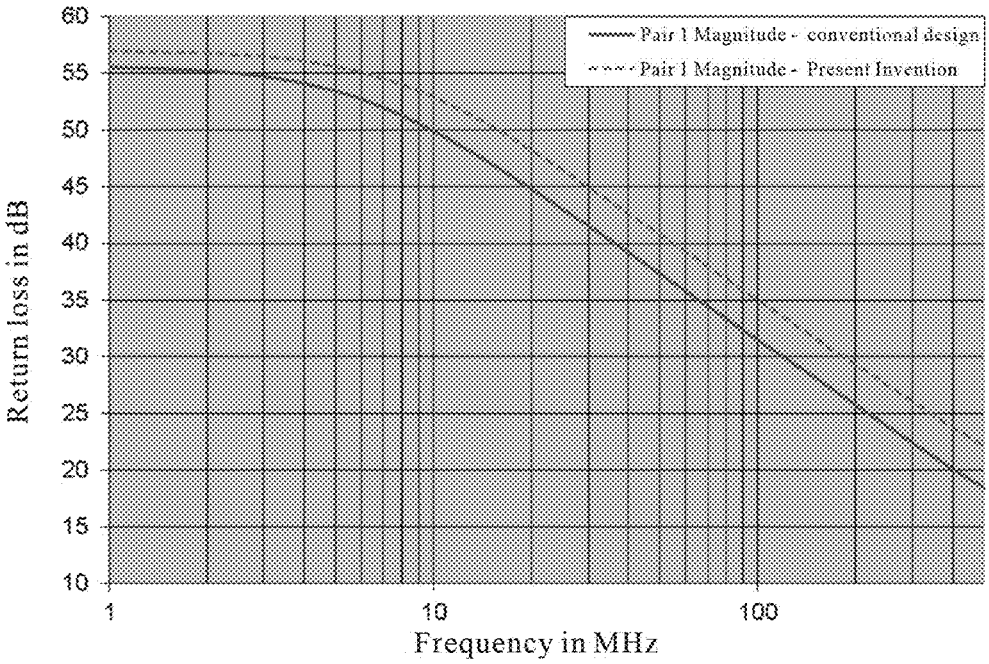
FIG. 13 is a graph of return loss magnitude against frequency according to a preferred embodiment of the present invention.
Figure 14:
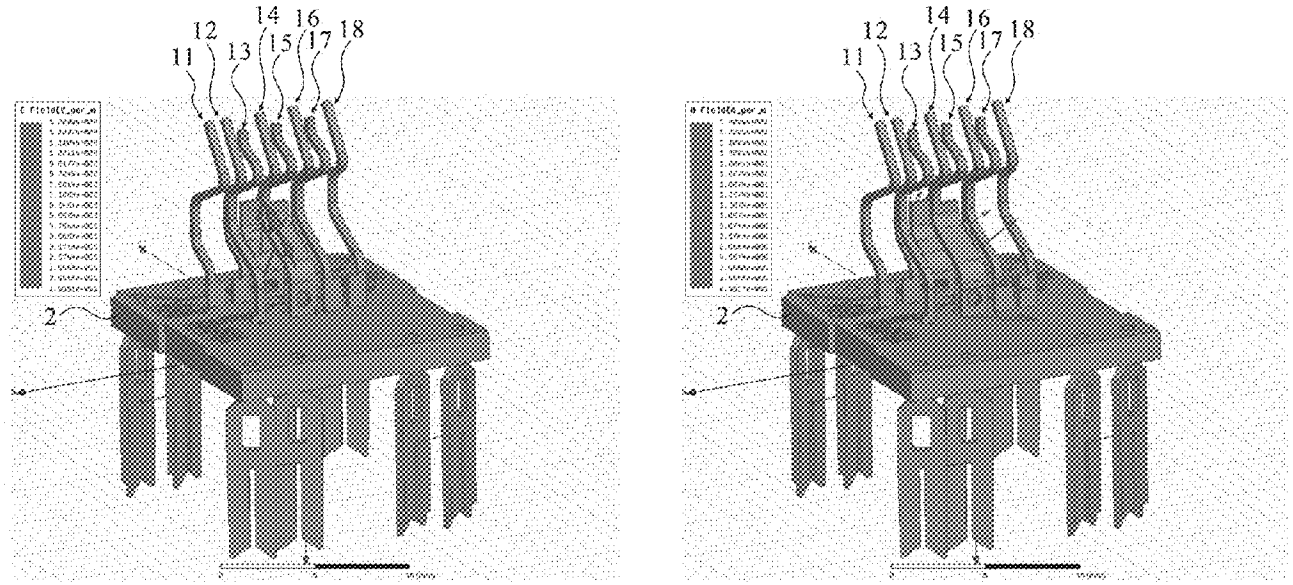
FIG. 14 is a schematic view of an electrical field and a magnetic field according to a preferred embodiment of the present invention.
Figure 14:
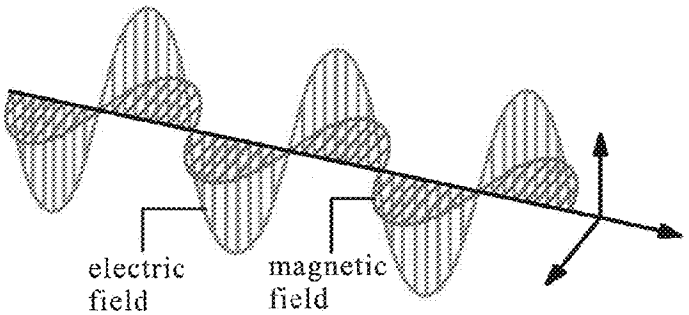
Figure 16:
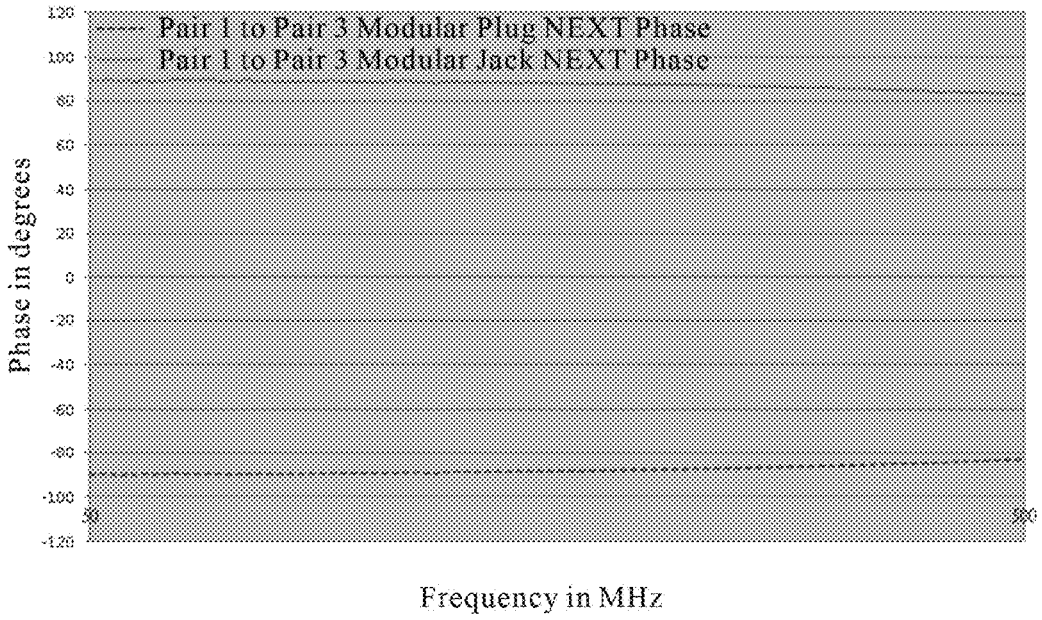
FIG. 16 is a graph of phase against frequency and a graph of magnitude against frequency according to a preferred embodiment of the present invention.
Figure 16:
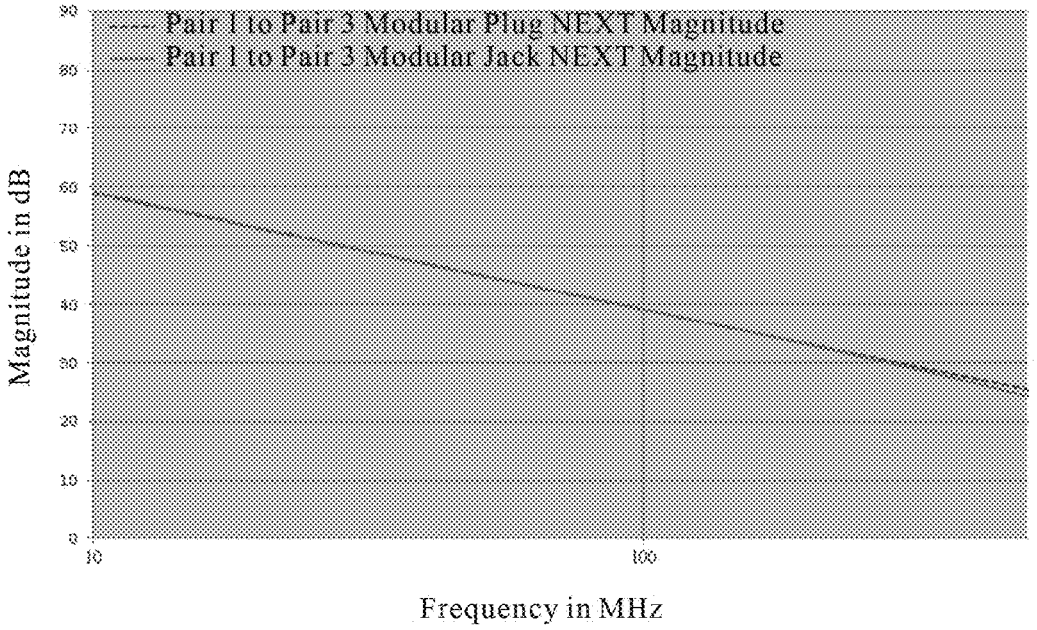
Figure 17:
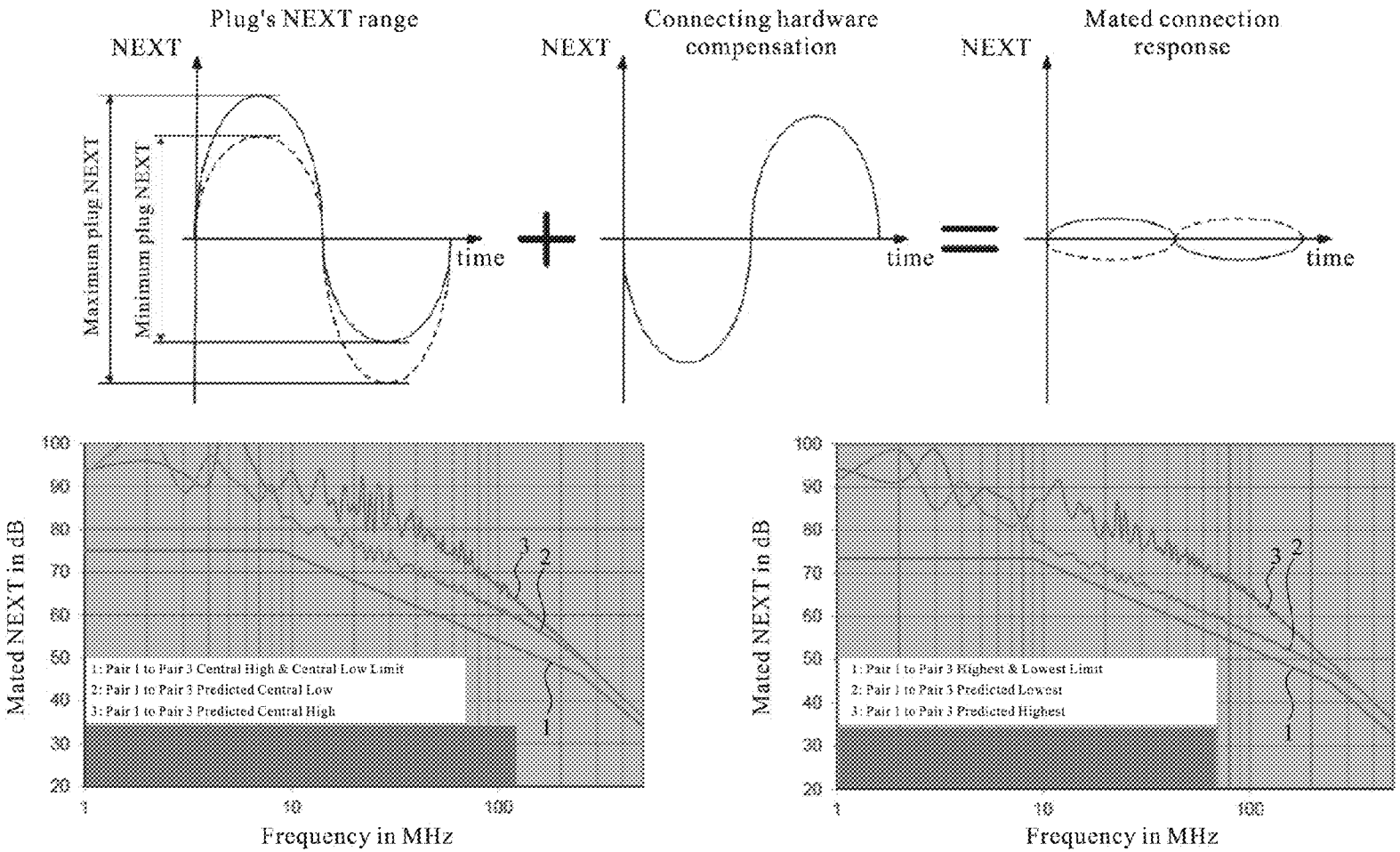
FIG. 17 is a plug and jack mated results according to a preferred embodiment of the present invention.
Figure 18:
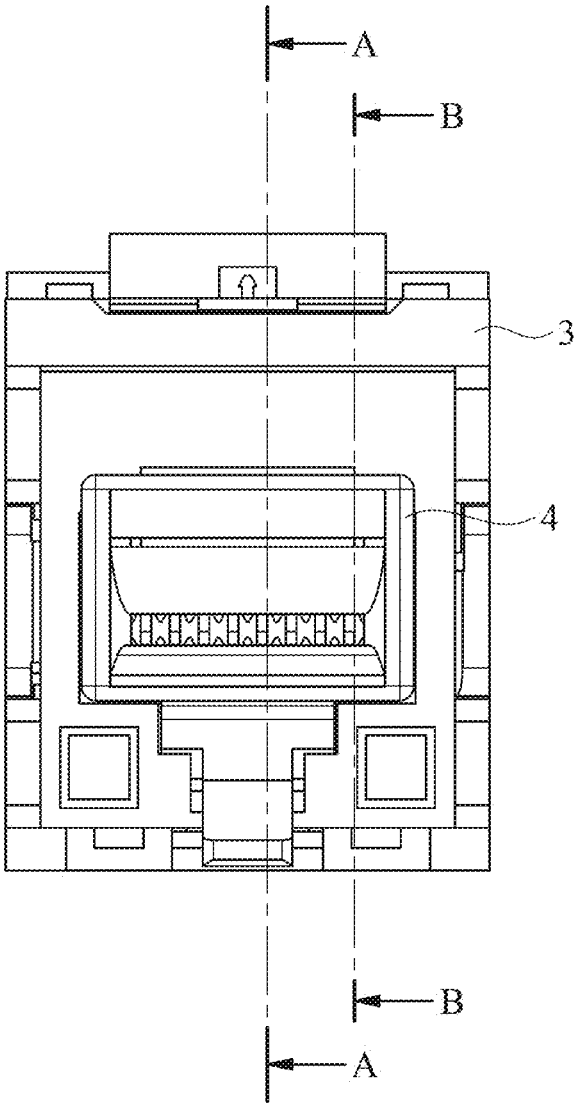
FIG. 18 is a front view of FIG. 11.
Figure 19:
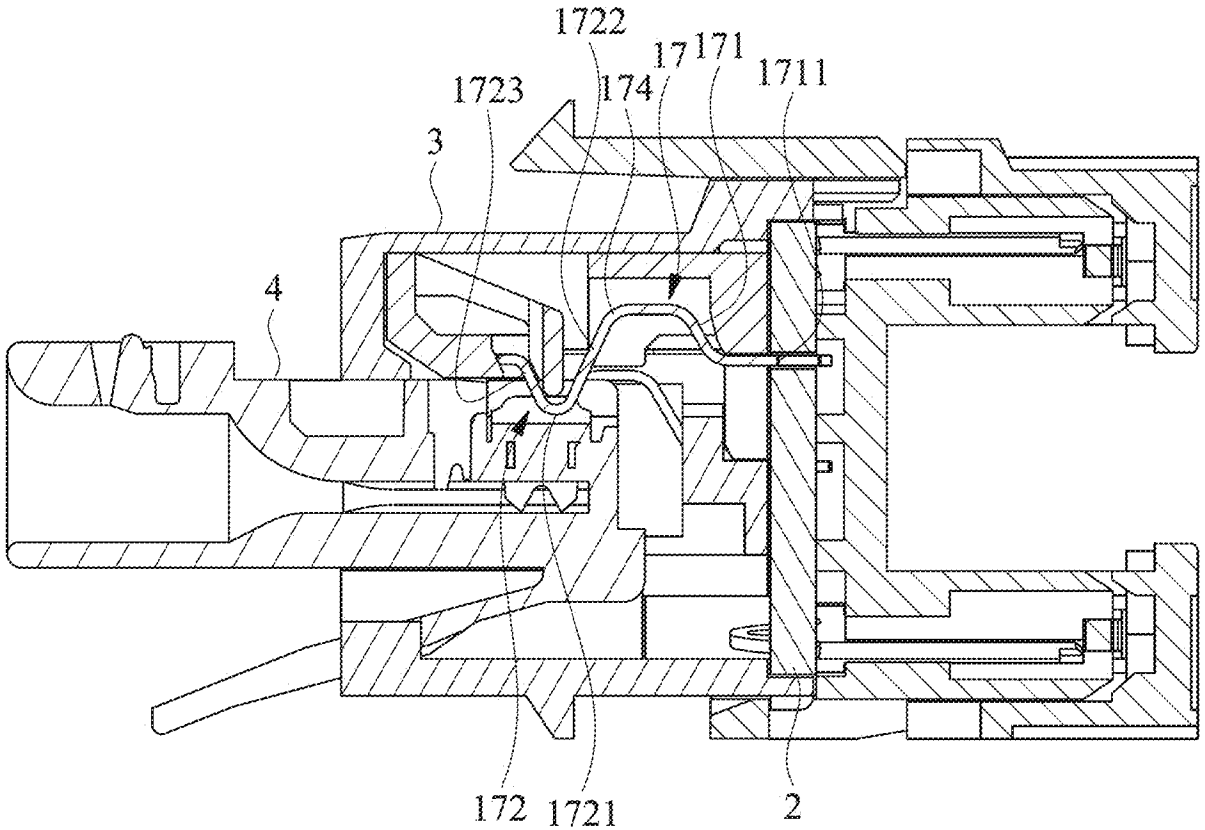
FIG. 19 is a cross-sectional view taken along line A-A of FIG. 18.
Figure 20:
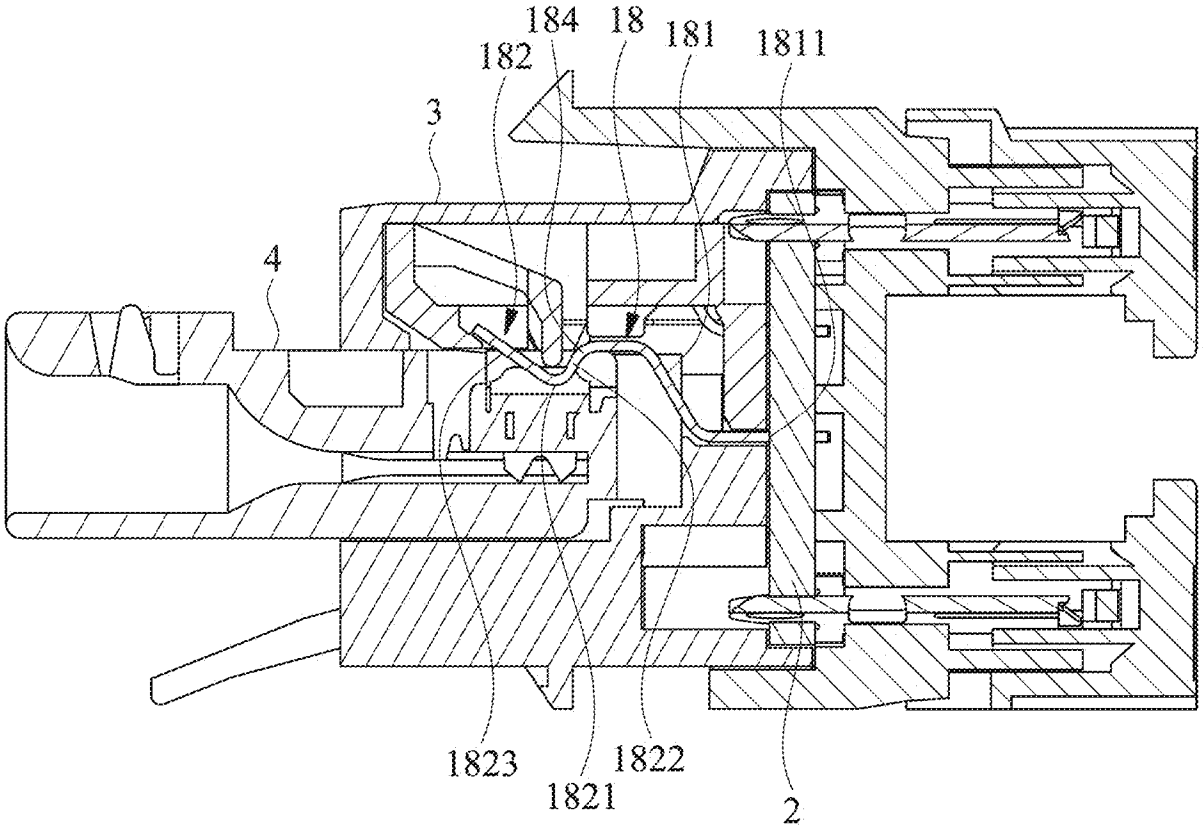
FIG. 20 is a cross-sectional view taken along line B-B of FIG. 18.

As indicated above, on the condition that the geometrical structure of the modular jack 3 is practicable, the farther the first straight line 91 and the second straight line 92 are spaced apart, the lesser is the capacitive and inductive interference between the third resilient pin 13 and the fourth resilient pin 14, and the lesser is the capacitive and inductive interference between the fifth resilient pin 15 and the sixth resilient pin 16. The fourth electrically conducting segment 141 and the fifth electrically conducting segment 151 are of sufficient width to form a shared capacitance for storing electrical energy. The wider the fourth electrically conducting segment 141 and the fifth electrically conducting segment 151 at the time when upper and lower capacitance is formed, the lesser is the fringing field. Since the impedance of the first differential pair (composed of the fourth resilient pin 14 and the fifth resilient pin 15) is placed under control, the radio frequency fringing effect of the first differential pair on the third differential pair is minimized relative to that of the other differential pairs on the third differential pair, thereby reducing the emission of first differential pair toward the third differential pair, as shown in FIG. 16. Furthermore, since the impedance of the first differential pair is placed under control, the return loss of the first differential pair is reduced, as shown in FIG. 13. Referring to FIG. 14, the fourth electrically conducting segment 141 and the fifth electrically conducting segment 151 are wide enough to concentrate the vector of the electrical field and generate induction laterally—for example, the fourth resilient pin 14 points at the sixth resilient pin 16, whereas the fifth resilient pin 15 points at the third resilient pin 13.

Furthermore, crosstalk magnitude and phase are offset when compensated for. The fourth electrically conducting segment 141 and the fifth electrically conducting segment 151 are each wide enough to decrease the distance between the fourth resilient pin 14 and the sixth resilient pin 16 and decrease the distance between the fifth resilient pin 15 and the third resilient pin 13, wherein their magnetic coupling provides the transfer polarity, that is, equal magnitude and opposite phase, required for the offset.

Figure 15:
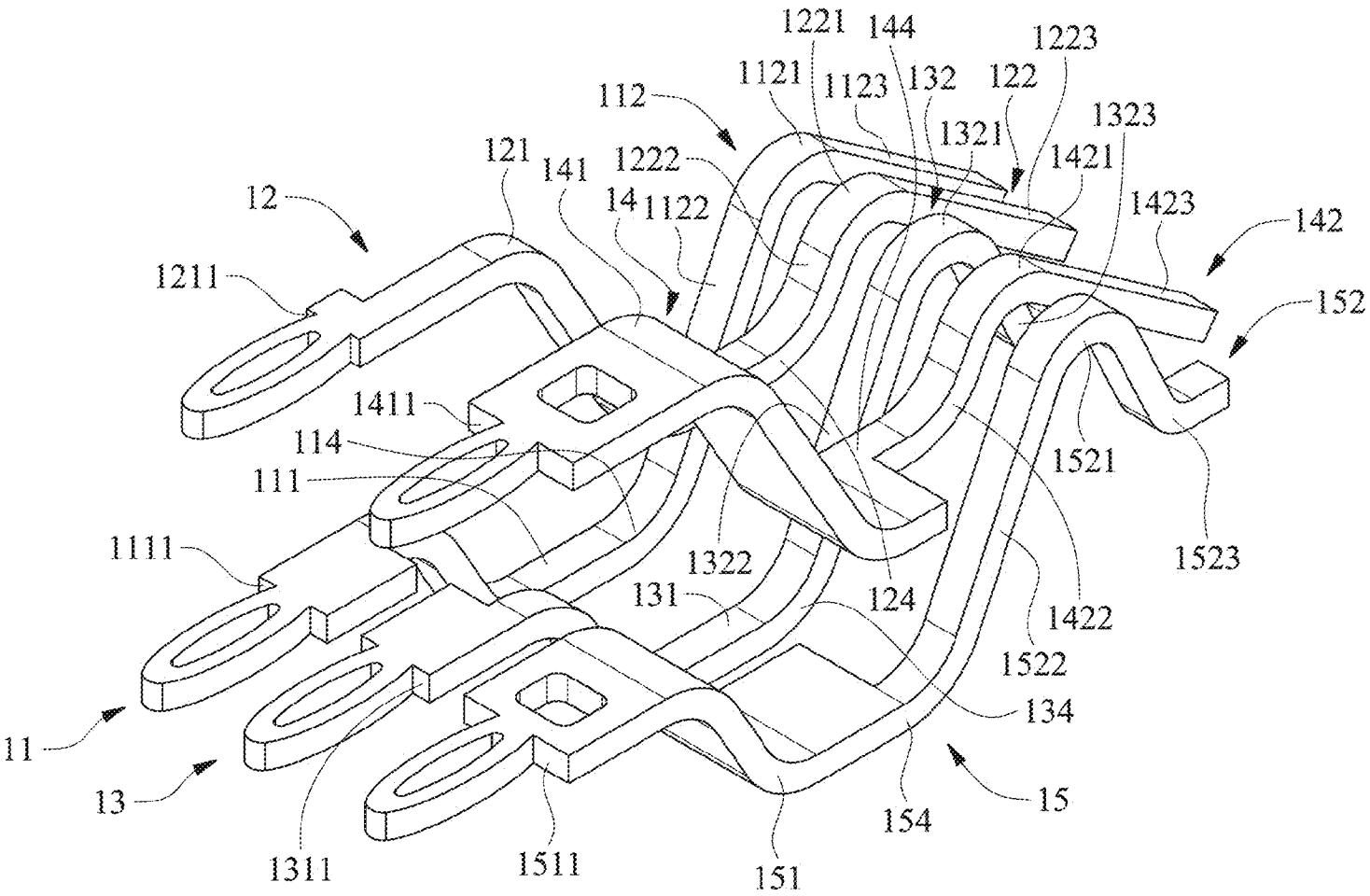
FIG. 15 is a schematic view of a fourth resilient pin and a fifth resilient pin according to a preferred embodiment of the present invention.

Referring to FIG. 15, regarding the pin structure 1 of the modular jack, the fourth electrically conducting segment 141 and the fifth electrically conducting segment 151 are a coupling length of 7 cm and a coupling width of 1.5 cm. Furthermore, in order for the fourth electrically contacting segment 142 and the fifth electrically contacting segment 152 to come into electrical contact with the modular plug and prevent the fourth electrically contacting segment 142 and the fifth electrically contacting segment 152 from colliding with each other, it is necessary that the minimum practical length from the fourth junction 144 of the fourth electrically contacting segment 142 and the fourth electrically conducting segment 141 to the fourth V-shaped electrically contacting portion 1421 equals 2 cm, and the minimum practical length from the fifth junction 154 of the fifth electrically contacting segment 152 and the fifth electrically conducting segment 151 to the fifth V-shaped electrically contacting portion 1521 equals 4 cm. Hence, the aforesaid geometrical structure provides signals of equal magnitude and opposite phases relative to the noise generated from the electrical contact area of the modular jack 3 and the modular plug 4 so as to eliminate near end crosstalk.

Referring to FIG. 5 and FIG. 18 through FIG. 20, as regards the pin structure 1 of the modular jack, the first electrically contacting segment 112 has a first inner segment 1122 and a first outer segment 1123 which are connected to two ends of the first V-shaped electrically contacting portion 1121, respectively, and the first inner segment 1122 is connected to the first electrically conducting segment 111.

The second electrically contacting segment 122 has a second inner segment 1222 and a second outer segment 1223 which are connected to two ends of the second V-shaped electrically contacting portion 1221, respectively, and the second inner segment 1222 is connected to the second electrically conducting segment 121.

The third electrically contacting segment 132 has a third inner segment 1322 and a third outer segment 1323 which are connected to two ends of the third V-shaped electrically contacting portion 1321, respectively, and the third inner segment 1322 is connected to the third electrically conducting segment 131.

The fourth electrically contacting segment 142 has a fourth inner segment 1422 and a fourth outer segment 1423 which are connected to two ends of the fourth V-shaped electrically contacting portion 1421, respectively, and the fourth inner segment 1422 is connected to the fourth electrically conducting segment 141.

The fifth electrically contacting segment 152 has a fifth inner segment 1522 and a fifth outer segment 1523 which are connected to two ends of the fifth V-shaped electrically contacting portion 1521, respectively, and the fifth inner segment 1522 is connected to the fifth electrically conducting segment 151.

The sixth electrically contacting segment 162 has a sixth inner segment 1622 and a sixth outer segment 1623 which are connected to two ends of the sixth V-shaped electrically contacting portion 1621, respectively, and the sixth inner segment 1622 is connected to the sixth electrically conducting segment 161.

The seventh electrically contacting segment 172 has a seventh inner segment 1722 and a seventh outer segment 1723 which are connected to two ends of the seventh V-shaped electrically contacting portion 1721, respectively, and the seventh inner segment 1722 is connected to the seventh electrically conducting segment 171.

The eighth electrically contacting segment 182 has an eighth inner segment 1822 and an eighth outer segment 1823 which are connected to two ends of the eighth V-shaped electrically contacting portion 1821, respectively, and the eighth inner segment 1822 is connected to the eighth electrically conducting segment 181. The pin structure 1 of the modular jack of the present invention can optionally dispense with the outer segments 1123, 1223, 1323, 1423, 1523, 1623, 1723, 1823. Alternatively, to render the electrically contacting segments 112, 122, 132, 142, 152, 162, 172, 182 non-floating, the pin structure 1 of the modular jack of the present invention is equipped with the outer segments 1123, 1223, 1323, 1423, 1523, 1623, 1723, 1823 so as be capable of structural restriction. The tail ends of the third outer segment 1323, the fifth outer segment 1523, and the seventh outer segment 1723 can be bent to be horizontal.

Furthermore, when the pin structure 1 of the modular jack of the present invention is additionally equipped with the outer segments 1123, 1223, 1323, 1423, 1523, 1623, 1723, 1823, it is necessary for the inner segments 1122, 1222, 1322, 1422, 1522, 1622, 1722, 1822 to lie on the same plane, for the included angle of the third inner segment 1322 and the third outer segment 1323, the included angle of the fifth inner segment 1522 and the fifth outer segment 1523, and the included angle of the seventh inner segment 1722 and the seventh outer segment 1723 to equal 50 degrees, and for the included angle of the first inner segment 1122 and the first outer segment 1123, the included angle of the second inner segment 1222 and the second outer segment 1223, the included angle of the fourth inner segment 1422 and the fourth outer segment 1423, the included angle of the sixth inner segment 1622 and the sixth outer segment 1623, and the included angle of the eighth inner segment 1822 and the eighth outer segment 1823 to equal 80 degrees, in order to preclude coupling-induced interference between the first differential pair and the third differential pair.

Figure 5:
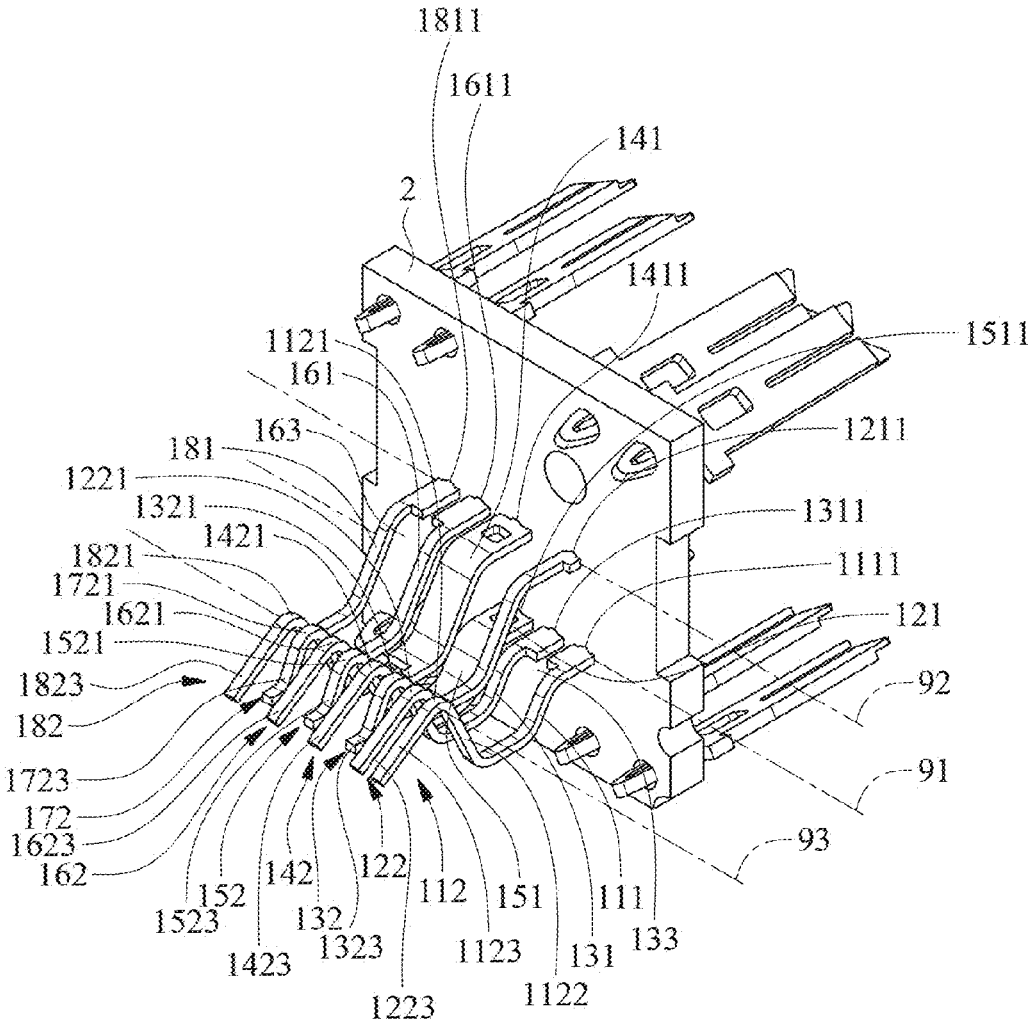
FIG. 5 is a perspective view of a preferred embodiment of the present invention.
Figure 6:
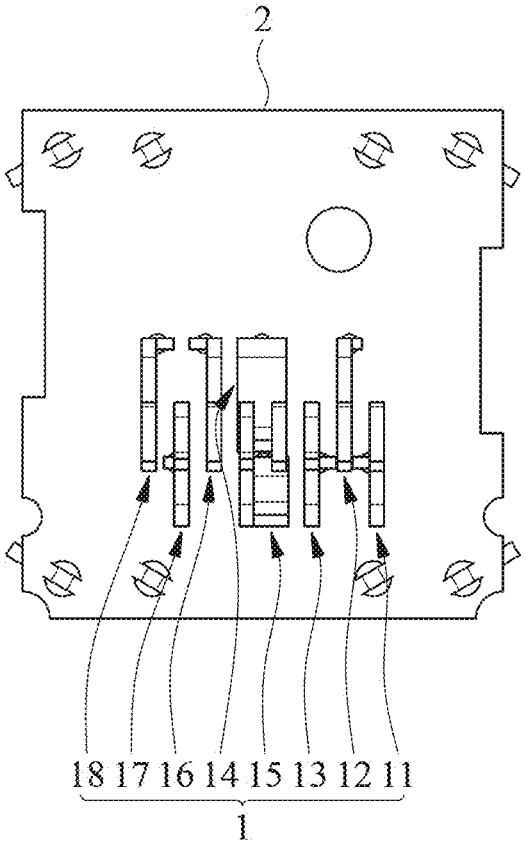
FIG. 6 is a front view of FIG. 5.
Figure 7:
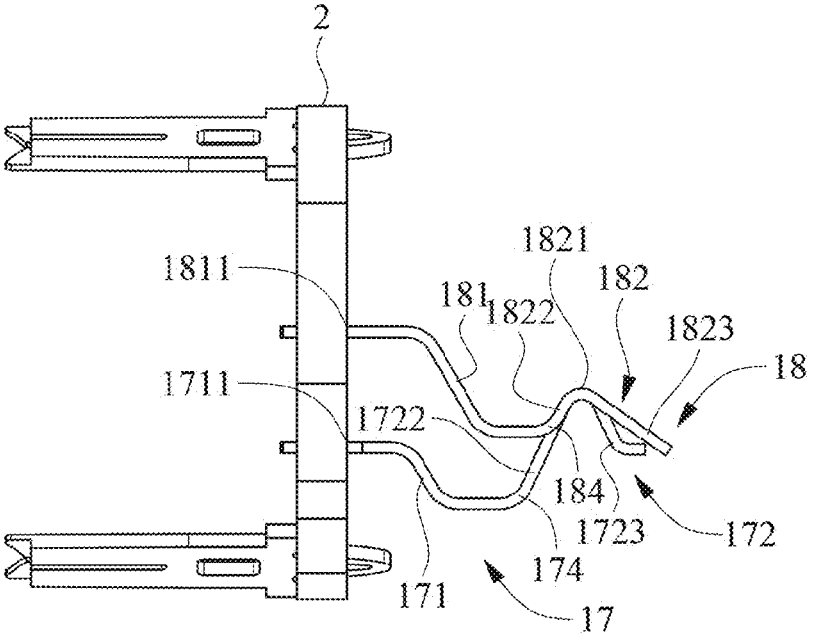
FIG. 7 is a left side view of FIG. 5.
Figure 8:
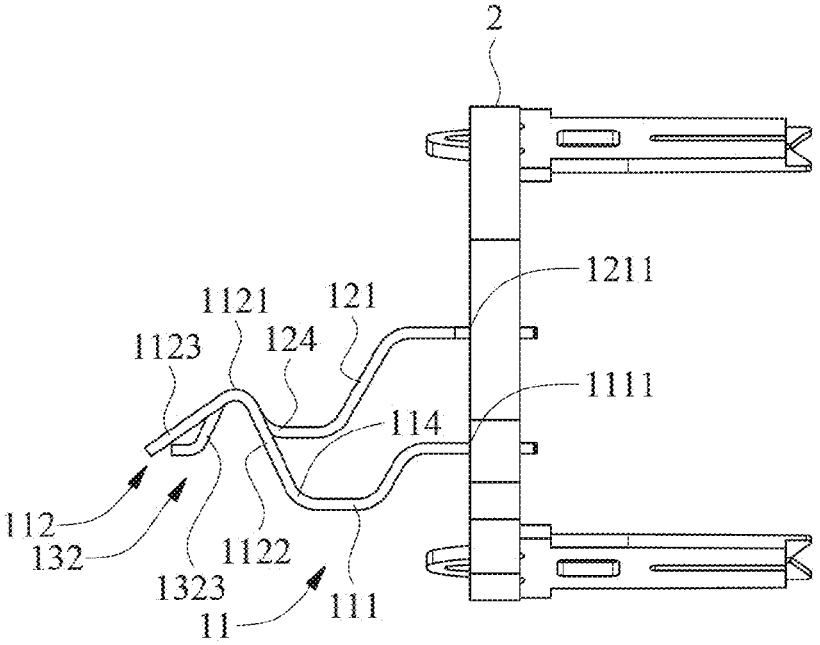
FIG. 8 is a right side view of FIG. 5.
Figure 9:
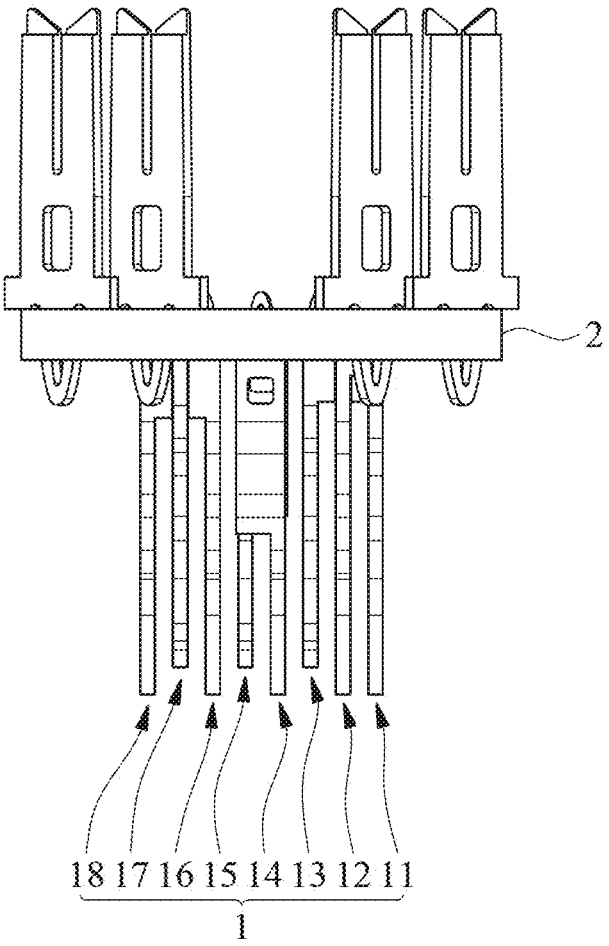
FIG. 9 is a top view of FIG. 5.
Figure 10:
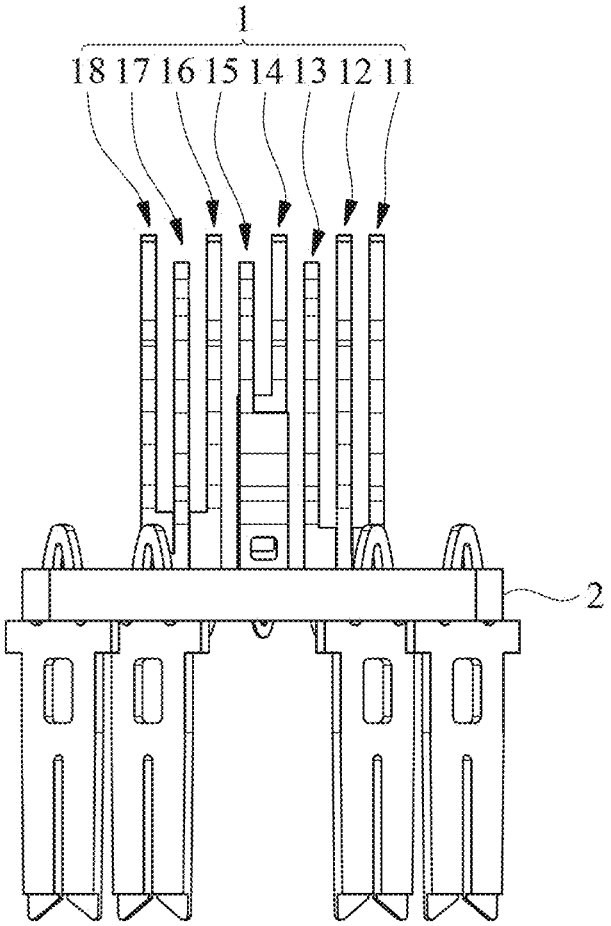
FIG. 10 is a bottom view of FIG. 5.
Figure 11:
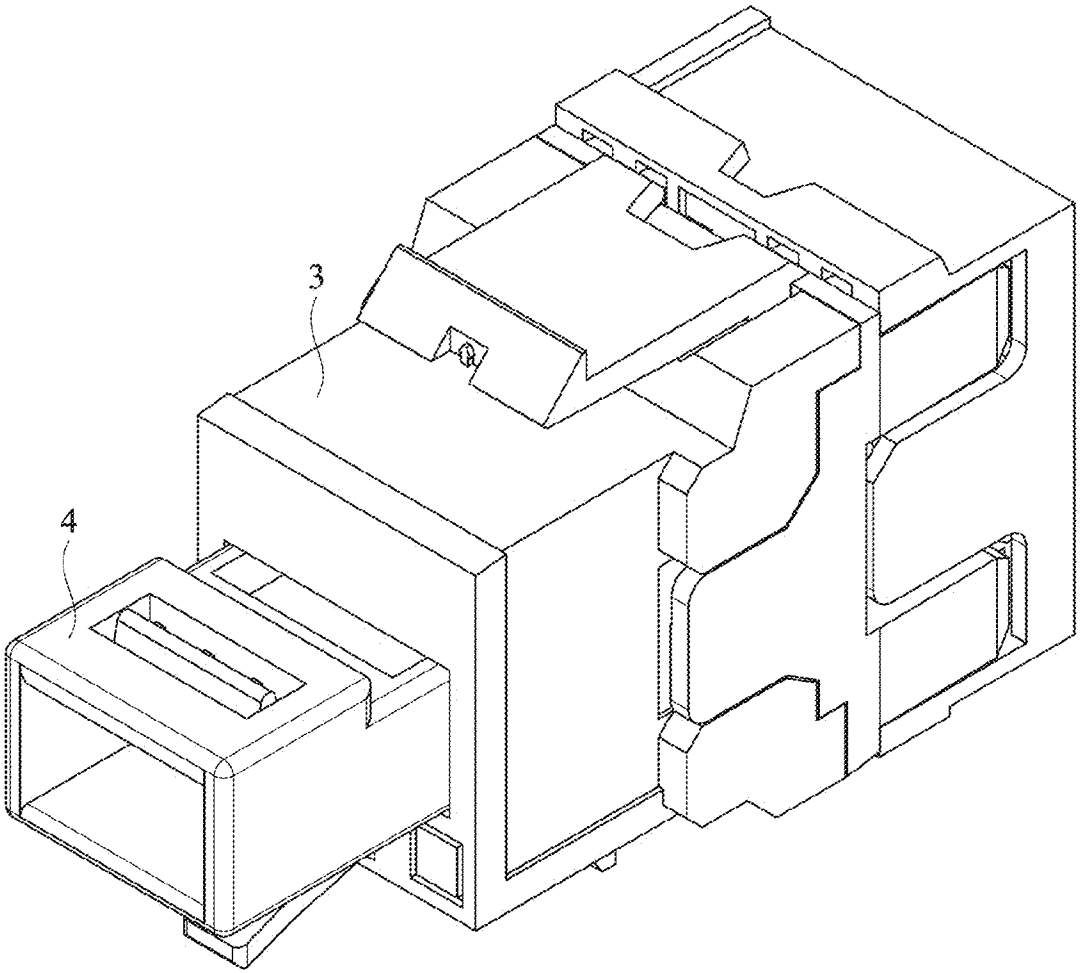
FIG. 11 is a first schematic view of a preferred embodiment of the present invention.
Figure 12:
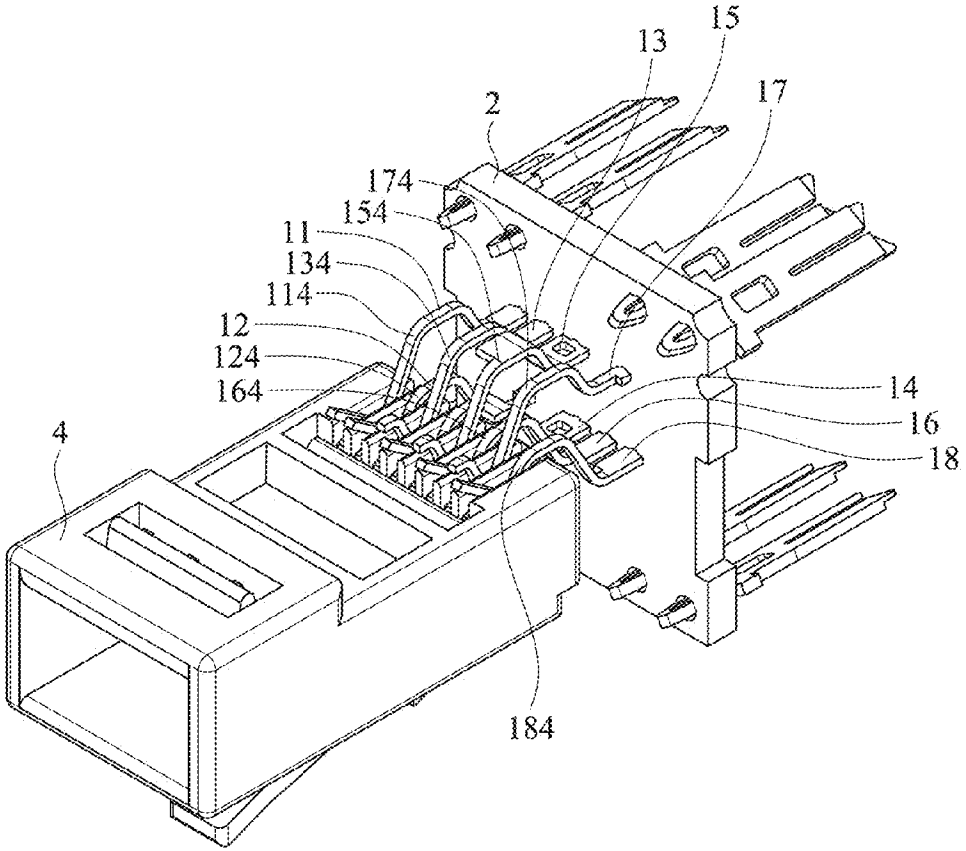
FIG. 12 is a second schematic view of a preferred embodiment of the present invention.

Referring to FIG. 5, in the pin structure 1 of the modular jack, the first resilient pin 11 is L-shaped, and the third resilient pin 13 is L-shaped. Alternatively, the first resilient pin 11 and the third resilient pin 13 are each L-shaped. Hence, a first U-shaped notch 133 is disposed between the first resilient pin 11 and the third resilient pin 13, such that the second resilient pin 12 can be disposed at the first U-shaped notch 133 between the first resilient pin 11 and the third resilient pin 13.

Referring to FIG. 5, in the pin structure 1 of the modular jack, the sixth resilient pin 16 is L-shaped, and the eighth resilient pin 18 is L-shaped. Alternatively, the sixth resilient pin 16 and the eighth resilient pin 18 are each L-shaped. Hence, a second U-shaped notch 163 is disposed between the sixth resilient pin 16 and the eighth resilient pin 18, such that the seventh resilient pin 17 can be disposed at the second U-shaped notch 163 between the sixth resilient pin 16 and the eighth resilient pin 18.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A pin structure of a modular jack, comprising:

a first resilient pin having a first electrically conducting segment and a first electrically contacting segment connected to the first electrically conducting segment, the first electrically conducting segment having a first electrically fixing end, and the first electrically contacting segment having a first V-shaped electrically contacting portion;

a second resilient pin having a second electrically conducting segment and a second electrically contacting segment connected to the second electrically conducting segment, the second electrically conducting segment having a second electrically fixing end, and the second electrically contacting segment having a second V-shaped electrically contacting portion;

a third resilient pin having a third electrically conducting segment and a third electrically contacting segment connected to the third electrically conducting segment, the third electrically conducting segment having a third electrically fixing end, and the third electrically contacting segment having a third V-shaped electrically contacting portion;

a fourth resilient pin having a fourth electrically conducting segment and a fourth electrically contacting segment connected to the fourth electrically conducting segment, the fourth electrically conducting segment having a fourth electrically fixing end, and the fourth electrically contacting segment having a fourth V-shaped electrically contacting portion;

a fifth resilient pin having a fifth electrically conducting segment and a fifth electrically contacting segment connected to the fifth electrically conducting segment, the fifth electrically conducting segment having a fifth electrically fixing end, and the fifth electrically contacting segment having a fifth V-shaped electrically contacting portion;

a sixth resilient pin having a sixth electrically conducting segment and a sixth electrically contacting segment connected to the sixth electrically conducting segment, the sixth electrically conducting segment having a sixth electrically fixing end, and the sixth electrically contacting segment having a sixth V-shaped electrically contacting portion;

a seventh resilient pin having a seventh electrically conducting segment and a seventh electrically contacting segment connected to the seventh electrically conducting segment, the seventh electrically conducting segment having a seventh electrically fixing end, the seventh electrically contacting segment having a seventh V-shaped electrically contacting portion; and an eighth resilient pin with an eighth electrically conducting segment and an eighth electrically contacting segment connected to the eighth electrically conducting segment, the eighth electrically conducting segment having an eighth electrically fixing end, and the eighth electrically contacting segment having an eighth V-shaped electrically contacting portion, wherein the fourth electrically conducting segment and the fifth electrically conducting segment are vertically spaced apart and are each wide, wherein the fourth electrically contacting segment and the fifth electrically contacting segment are disposed on different sides of the fourth electrically conducting segment and the fifth electrically conducting segment, respectively, and transversely spaced apart, and are each slender, wherein the other resilient pins are spaced transversely and consecutively apart and disposed on two sides of the fourth resilient pin and the fifth resilient pin, respectively and are each slender, wherein the first electrically fixing end, the third electrically fixing end, the fifth electrically fixing end and the seventh electrically fixing end lie in a first straight line, wherein the second electrically fixing end, the fourth electrically fixing end, the sixth electrically fixing end and the eighth electrically fixing end lie in a second straight line, wherein the first straight line and the second straight line are spaced apart and lie on a same plane, wherein the V-shaped electrically contacting portions lie in a third straight line.

2. The pin structure of claim 1, wherein the fourth electrically conducting segment and the fifth electrically conducting segment are of a coupling length of 7 cm and a coupling width of 1.5 cm, wherein a distance from a fourth junction of the fourth electrically contacting segment and the fourth electrically conducting segment to the fourth V-shaped electrically contacting portion equals 2 cm, wherein a distance from a fifth junction of the fifth electrically contacting segment and the fifth electrically conducting segment to the fifth V-shaped electrically contacting portion equals 4 cm.

3. The pin structure of claim 1, characterized in that:

the first electrically contacting segment has a first inner segment and a first outer segment which are connected to two ends of the first V-shaped electrically contacting portion, respectively, and the first inner segment is connected to the first electrically conducting segment;

the second electrically contacting segment has a second inner segment and a second outer segment which are connected to two ends of the second V-shaped electrically contacting portion, respectively, and the second inner segment is connected to the second electrically conducting segment;

the third electrically contacting segment has a third inner segment and a third outer segment which are connected to two ends of the third V-shaped electrically contacting portion, respectively, and the third inner segment is connected to the third electrically conducting segment;

the fourth electrically contacting segment has a fourth inner segment and a fourth outer segment which are connected to two ends of the fourth V-shaped electrically contacting portion, respectively, and the fourth inner segment is connected to the fourth electrically conducting segment;

the fifth electrically contacting segment has a fifth inner segment and a fifth outer segment which are connected to two ends of the fifth V-shaped electrically contacting portion, respectively, and the fifth inner segment is connected to the fifth electrically conducting segment;

the sixth electrically contacting segment has a sixth inner segment and a sixth outer segment which are connected to two ends of the sixth V-shaped electrically contacting portion, respectively, and the sixth inner segment is connected to the sixth electrically conducting segment;

the seventh electrically contacting segment has a seventh inner segment and a seventh outer segment which are connected to two ends of the seventh V-shaped electrically contacting portion, respectively, and the seventh inner segment is connected to the seventh electrically conducting segment; and the eighth electrically contacting segment has an eighth inner segment and an eighth outer segment which are connected to two ends of the eighth V-shaped electrically contacting portion, respectively, and the eighth inner segment is connected to the eighth electrically conducting segment, wherein the inner segments lie on a same plane, wherein an included angle of the third inner segment and the third outer segment, an included angle of the fifth inner segment and the fifth outer segment, and an included angle of the seventh inner segment and the seventh outer segment equal 50 degrees, wherein an included angle of the first inner segment and the first outer segment, an included angle of the second inner segment and the second outer segment, an included angle of the fourth inner segment and the fourth outer segment, an included angle of the sixth inner segment and the sixth outer segment, and an included angle of the eighth inner segment and the eighth outer segment equal 80 degrees.

4. The pin structure of claim 1, wherein the second resilient pin is disposed at a first U-shaped notch between the first resilient pin and the third resilient pin.

5. The pin structure of claim 1, wherein the seventh resilient pin is disposed at a second U-shaped notch between the sixth resilient pin and the eighth resilient pin.

* * * * *